US010947724B2

(12) United States Patent
Langeveld et al.

(10) Patent No.: US 10,947,724 B2
(45) Date of Patent: Mar. 16, 2021

(54) CEILING SYSTEM

(71) Applicant: Hunter Douglas Industries B.V., Rotterdam (NL)

(72) Inventors: Michiel Jacobus Johannes Langeveld, Zoetermeer (NL); John Paulus Alfred Fick, Rijen (NL)

(73) Assignee: Hunter Douglas Industries B.V., Rotterdam (NL)

( * ) Notice: Subject to any disclaimer, the term of this patent is extended or adjusted under 35 U.S.C. 154(b) by 0 days.

(21) Appl. No.: 16/502,311

(22) Filed: Jul. 3, 2019

(65) Prior Publication Data

US 2020/0011055 A1 Jan. 9, 2020

(30) Foreign Application Priority Data

Jul. 4, 2018 (EP) ..... 18181740

(51) Int. Cl.

| | |
|---|---|
| ***E04B 9/06*** | (2006.01) |
| ***E04B 9/16*** | (2006.01) |
| ***E04B 9/28*** | (2006.01) |
| ***E04B 9/36*** | (2006.01) |

(52) U.S. Cl.

CPC ..... *E04B 9/065* (2013.01); *E04B 9/16* (2013.01); *E04B 9/28* (2013.01); *E04B 9/363* (2013.01)

(58) Field of Classification Search

CPC ... E04B 9/363; E04B 9/28; E04B 9/16; E04B 9/065

See application file for complete search history.

(56) References Cited

U.S. PATENT DOCUMENTS

| | | | | |
|---|---|---|---|---|
| 1,778,344 A | | 10/1930 | Venzie | |
| 2,802,551 A | * | 8/1957 | Roberts | E04B 9/363 52/561 |
| 2,866,233 A | | 12/1958 | Lydard | |
| 2,920,357 A | | 1/1960 | Ericson | |
| 3,131,447 A | | 5/1964 | Tinnerman | |
| 3,350,829 A | | 11/1967 | Dalby | |
| 3,412,516 A | * | 11/1968 | Lindstrom | E04B 9/363 52/506.1 |
| 3,678,641 A | | 7/1972 | Englund | |
| 3,708,941 A | | 1/1973 | Cuckson | |

(Continued)

FOREIGN PATENT DOCUMENTS

| | | |
|---|---|---|
| DE | 9310494 | 9/1993 |
| DE | 29612593 | 10/1996 |

(Continued)

OTHER PUBLICATIONS

European Patent Office EP Application No. 17200567.0-1005, dated Mar. 22, 2018 (7 pages).

(Continued)

*Primary Examiner* — Paola Agudelo
(74) *Attorney, Agent, or Firm* — Dority & Manning, P.A.

(57) ABSTRACT

A ceiling system, comprising at least two elongate carriers, configured to support at least one ceiling panel; at least one elongate beam; and at least two connecting brackets; wherein each elongate carrier is supported at one or more suspension locations; each elongate beam is coupled to at least two elongate carriers by a respective connecting bracket; and the connecting brackets are coupled to the elongate carriers by a push-fit connection.

23 Claims, 6 Drawing Sheets

(56) References Cited

U.S. PATENT DOCUMENTS

| | | | | | |
|---|---|---|---|---|---|
| 4,047,348 | A | | 9/1977 | McSweeney | |
| 4,309,858 | A | * | 1/1982 | Anderle | E04B 9/36 52/506.08 |
| 4,328,653 | A | * | 5/1982 | Anderle | E04B 9/363 52/460 |
| 4,364,215 | A | * | 12/1982 | Gailey | E04B 9/065 403/347 |
| 4,426,822 | A | | 1/1984 | Gailey | |
| 4,516,296 | A | | 5/1985 | Sherman | |
| 4,614,072 | A | | 9/1986 | Price | |
| 4,646,506 | A | * | 3/1987 | Slapsys | E04B 9/363 52/460 |
| 4,757,663 | A | * | 7/1988 | Kuhr | E04B 2/7409 52/481.1 |
| 4,827,687 | A | * | 5/1989 | Frawley | E04B 9/10 52/473 |
| 5,115,611 | A | | 5/1992 | Lim | |
| 5,195,289 | A | | 3/1993 | Lalonde | |
| 5,265,333 | A | * | 11/1993 | Lim | E04B 9/36 29/521 |
| 5,393,021 | A | | 2/1995 | Nelson | |
| 2,720,289 | A | | 10/1995 | Henrickson | |
| 5,984,243 | A | | 11/1999 | Pfaller | |
| 6,318,042 | B1 | * | 11/2001 | Bloom | E04B 9/065 52/506.07 |
| 6,336,302 | B1 | | 1/2002 | Brugman et al. | |
| 6,434,908 | B1 | | 8/2002 | Ferrante | |
| 6,494,415 | B1 | * | 12/2002 | Roth | F16L 3/243 248/74.1 |
| 7,090,174 | B2 | | 8/2006 | Korczak | |
| 10,060,460 | B1 | | 8/2018 | Winn | |
| 10,294,675 | B2 | | 5/2019 | Langeveld | |
| 2010/0199594 | A1 | | 8/2010 | Wendt | |
| 2015/0059279 | A1 | | 3/2015 | Harper | |
| 2016/0251855 | A1 | * | 9/2016 | Heesbeen | E04B 9/225 52/506.05 |
| 2016/0281881 | A1 | | 9/2016 | Vaccaro | |
| 2017/0284104 | A1 | | 10/2017 | Hatzinkolas | |
| 2018/0334803 | A1 | * | 11/2018 | Underkofler | E04B 9/225 |
| 2019/0024373 | A1 | * | 1/2019 | Langeveld | E04B 9/36 |

FOREIGN PATENT DOCUMENTS

| | | |
|---|---|---|
| DE | 20107617 | 10/2001 |
| FR | 2590304 | 5/1987 |
| FR | 2683566 | 5/1993 |

OTHER PUBLICATIONS

European Search Report issued in corresponding EP Application No. 19184484.4-1005 dated Nov. 27, 2019 (6 pages).

* cited by examiner

CEILING SYSTEM

CROSS-REFERENCE TO RELATED APPLICATIONS

This application is based upon and claims the right of priority to EP App. No. 18181740.4, filed Jul. 4, 2018, the disclosure of which is hereby incorporated herein by reference in its entirety for all purposes.

FIELD OF THE INVENTION

The following relates to a ceiling system, in particular a system for supporting a ceiling system such as a suspended ceiling.

BACKGROUND OF THE INVENTION

A variety of ceiling systems are known, in which ceiling panels are supported by carriers. It is desirable for such systems to be designed with consideration for the ease of installation whilst ensuring a good quality finish for the ceiling system once installed.

BRIEF DESCRIPTION OF THE INVENTION

As described herewith, there is provided a ceiling system, comprising at least two elongate carriers, configured to support at least one ceiling panel; at least one elongate beam; and at least two connecting brackets; wherein each elongate carrier is supported at one or more suspension locations; each elongate beam is coupled to at least two elongate carriers by a respective connecting bracket; and the connecting brackets are coupled to the elongate carriers by a push-fit connection.

BRIEF DESCRIPTION OF THE DRAWINGS

Embodiments will be more clearly understood from the following description, given by way of example only, with reference to the accompanying drawings, in which.

DETAILED DESCRIPTION OF THE INVENTION

Figure 1:
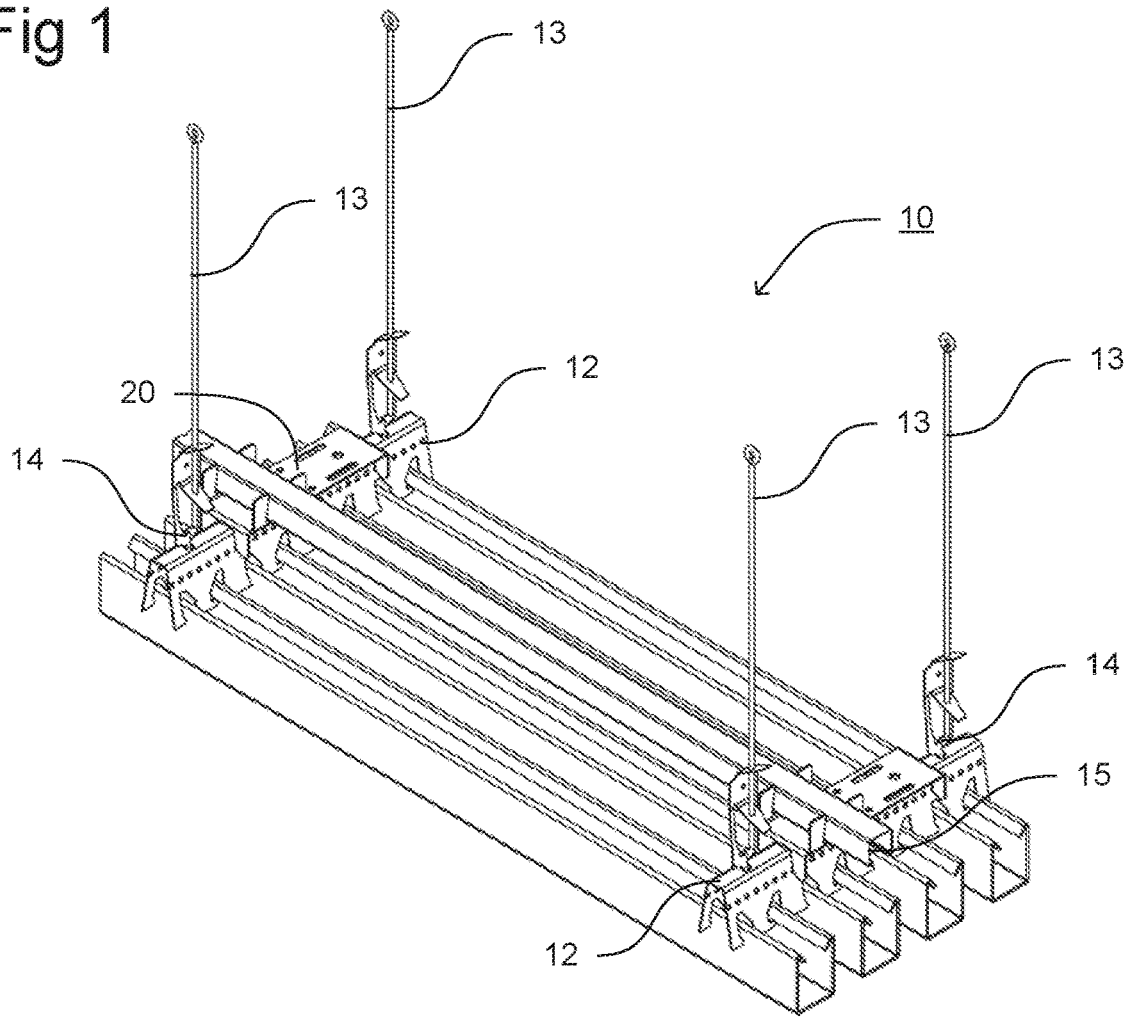
FIG. 1 illustrates a ceiling system.

FIG. 1 illustrates an example of a ceiling system 10. The ceiling system 10 is configured to support one or more ceiling panels 11. The ceiling panels 11 in this shown embodiment have a lower face that primarily forms the surface visible to occupants of the space below. However, as depicted in FIG. 1, there may be spaces between the ceiling panels 11 through which occupants may be able to see some of the structure supporting the ceiling panels 11 and/or the structure from which the ceiling system 10 may be suspended.

The ceiling panels 11 are supported by a plurality of elongate carriers 12. Thus, at least one ceiling panel may be supported by elongate carriers.

The elongate carriers 12 may also fix the position of adjacent ceiling panels 11 relative to each other. As shown, each elongate carrier 12 may support a plurality of ceiling panels 11. It should be appreciated that the number of ceiling panels 11 supported by each elongate carrier 12, and therefore the required length of the elongate carrier 12, will depend upon the size of the area to be covered by the ceiling system 10. In general, however, supporting the ceiling panels 11 by the elongate carriers 12 rather than supporting each ceiling panel 11 independently can reduce the number of connections to be made to a structure from which the ceiling system is suspended.

Each of the ceiling panels 11 may be supported by two or more elongate carriers 12 spaced apart along the length of the ceiling panels 11. It should be appreciated that the number of the elongate carriers 12 required to support the ceiling panels 11 may depend upon several factors, such as the length of ceiling panels 11 required to provide the area to be covered by the ceiling system 10 and the strength of the material chosen to form the ceiling panels 11. In an arrangement, the ceiling panels 11 are coupled to the elongate carriers 12 by a push-fit connection. Thus, the elongate carriers may be configured such that the at least one ceiling panel can be coupled to the elongate carriers by a push-fit connection.

Such an arrangement may facilitate installation of the ceiling panels 11 to the carriers 12 because no tools may be necessary in order to complete the connection.

It should be understood that by push-fit connection, it is meant any connection that may enable two components to be coupled by a user merely pushing one component into contact with another. Such a connection may avoid the requirement for separate fixings, such as nuts and bolts or other separate couplings, and/or may avoid the requirement for tools. An example of push-fit connections may include a snap-fit connection, in which one component may have one or more protrusions or features that engage with corresponding recesses, which may include grooves or dimples, or features on the other component. In such a connection, during the process of coupling the two components together, at least one of the components may also resiliently deform, usually temporarily, to enable the engagement of the protrusions with the corresponding recesses. A further example of a push-fit connection may include a friction-fit connection, in which part or all of one component may engage with a recess or protrusion or other cooperating feature within another component and/or between two parts of another component and be secured to it by the friction at the surfaces of the components that are in contact. It should be appreciated that other forms of push-fit connection may also be used.

Each of the elongate carriers 12 may be supported by a plurality of suspension hangers 13. The suspension hangers 13 may be directly or indirectly connected at one end to the elongate carriers 12. The suspension hangers 13 may be connected at their opposite end to a suitable location within the structure in which the ceiling system 10 is to be installed. For example, the suspension hangers 13 may be connected to a ceiling in a building and/or structural beams within a building.

The suspension hangers 13 are connected to the elongate carriers 12 at suspension locations 14 provided on the elongate carriers 12. It should be appreciated that the choice of locations of the suspension locations 14 may be determined based on the required stability of the ceiling system 10 overall and/or to facilitate the installation of the ceiling system 10, for example during an initial step to install the elongate carriers 12 before other components are added to the ceiling system 10. It should also be appreciated that the number of suspension hangers 13 required to support the ceiling system 10 depends on several factors, such as the size of the area to be covered by the ceiling system 10 and/or the weight of the ceiling system 10 and/or the panels.

As shown in FIG. 1, in an arrangement according to the present disclosure, an elongate beam 15 is connected between at least two elongate carriers 12. For example, an elongate beam 15 may be provided between adjacent elongate carriers 12 that are arranged side by side. The adjacent elongate carriers 12 may be arranged such that their elongate directions are parallel to each other. However, this is not essential and the elongate direction of one elongate carrier 12 may be at an oblique angle to the elongate direction of an adjacent elongate carrier. It should be appreciated that, in some arrangements, an elongate beam 15 may be connected to more than two elongate carriers 12. Similarly, more than one elongate beam 15 may be connected between two elongate carriers 12.

In an arrangement, the one or more elongate beams 15 may stabilize the relative positions of the elongate carriers 12 to which the one or more elongate beams 15 are connected. In other words the position of one elongate carrier 12 relative to the position of another elongate carrier 12 may be fixed. Such an arrangement may assist in providing a good quality finish for the completed ceiling system 10. For example, if an elongate carrier 12 moves relative to another elongate carrier 12, it may cause distortion of one or more ceiling panels 11 connected between the two elongate carriers 12, for example as a result of one part of the ceiling panel 11 moving relative to another part of the ceiling panel 1. This in turn may result in an undesirable irregular appearance of the ceiling panels 11 when viewed from below.

In an arrangement, the ceiling system 10 of the present disclosure may include ceiling panels 11 that are relatively flexible, for example more flexible than at least one of the elongate carriers 12 and the elongate beams 15. Ceiling systems 10 using such relatively flexible ceiling panels 11 may be particularly susceptible to a problem of distortion of the ceiling panels 11 caused by relative movement of the elongate carriers 12 because the ceiling panels 11 may not have sufficient stiffness to stabilize the position of one elongate carrier 12 relative to another elongate carrier 12. In an arrangement, the ceiling system 10 may include ceiling panels 11 made from felt. It should be appreciated, however, that an arrangement according to the present disclosure may also be beneficial for ceiling systems 10 that include relatively stiff ceiling panels 11, including for example ceiling panels 11 made from aluminium.

Figure 2:
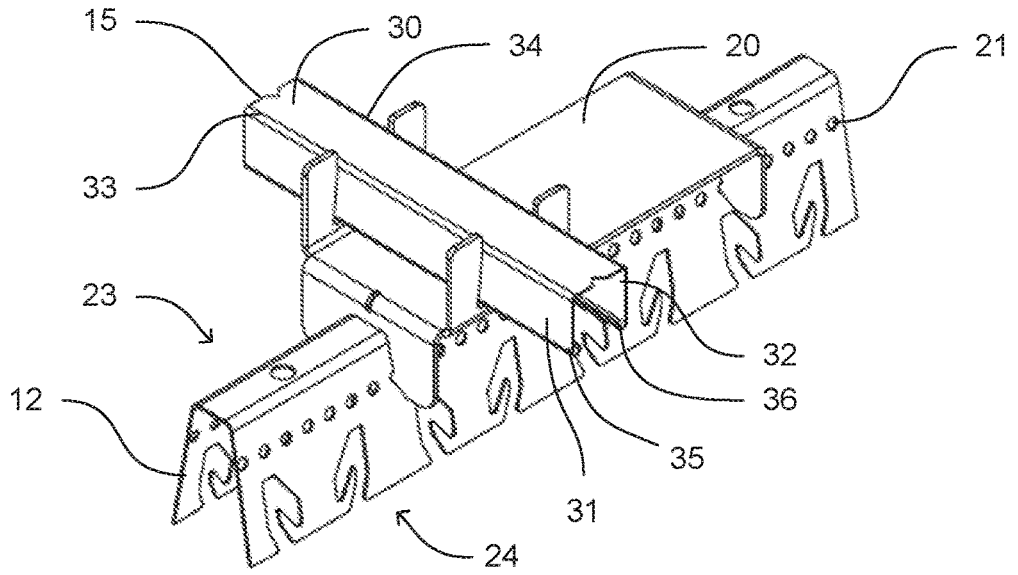
FIG. 2 illustrates a part of the ceiling system shown in FIG. 1.
Figure 3:
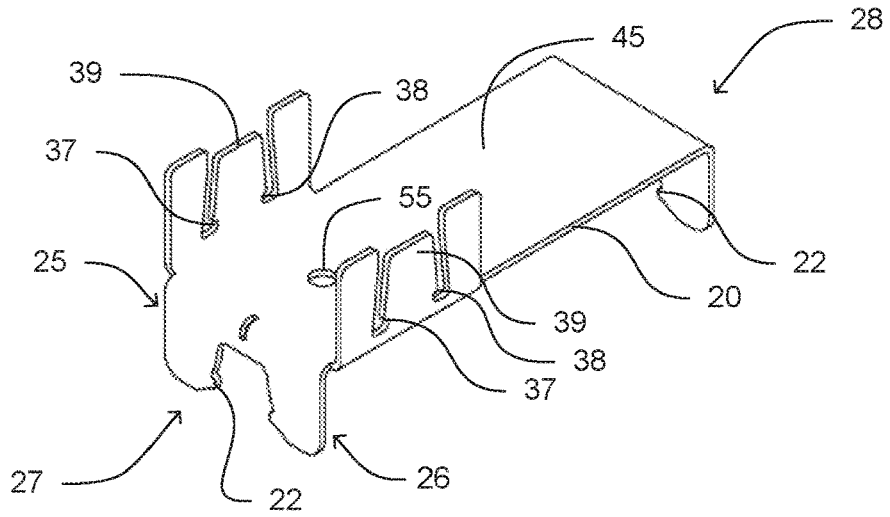
FIG. 3 illustrates a bracket for use in the ceiling system shown in FIG. 1.

FIG. 2 illustrates in more detail a connection between an elongate carrier 12 and an elongate beam 15 of the arrangement depicted in FIG. 1. The elongate beam 15 may be connected to the elongate carrier 12 at a location separate from a suspension location on the elongate carrier 12. As shown, the elongate beam 15 is connected to the elongate carrier 12 by a bracket 20. FIG. 3 illustrates the bracket of the arrangements shown in FIGS. 1 and 2 in more detail.

In the arrangements shown in FIGS. 1 to 3, the bracket 20 is configured to be connected to the elongate carrier by a snap-fit connection. Such an arrangement may enable quick and easy installation by a user without tools. It should be appreciated that other push-fit connections as discussed above may be used including, for example, friction-fit connections.

In the arrangement depicted in FIG. 2, the elongate carrier 12 includes a plurality of recesses, specifically apertures 21, into which corresponding protrusions 22 formed on the bracket 20 may be inserted in order to provide a secure snap-fit connection. In the arrangements shown in FIGS. 1 to 3, the elongate carrier 12 has a series of apertures 21 provided on first and second sides 23, 24 of the elongate carrier 12. Similarly, as shown in FIG. 3, the bracket 20 has protrusions 22 formed on first and second sides 25, 26 of the bracket 20. Accordingly, a protrusion 22 on the first side 25 of the bracket 20 engages with an aperture 21 on the first side 23 of the elongate carrier 12, and a protrusion 22 on the second side 26 of the bracket 20 engages with an aperture 21 on the second side 24 of the elongate carrier 12. Such an arrangement, once the protrusions 22 are engaged with the apertures 21, prevents movement of the bracket 20 in any direction relative to the elongate carrier 12 under a force up to a threshold force at which the snap-fit connection may release. Thus, in this arrangement, one of the connecting brackets and the elongate carrier has at least two recesses and the other of the connecting brackets and the elongate carriers has s at least two corresponding protrusions; and the connecting brackets are configured to couple to the elongate carriers by engagement of the protrusions within the recesses.

In an arrangement, as shown in FIGS. 1 to 3, the bracket 20 may have protrusions 22 provided at first and second ends 27, 28 of the bracket 20 that engage with respective apertures 21 on the elongate carrier 12. The first and second ends 27, 28 of the bracket 20 may be spaced apart along a length of the bracket 20. Such an arrangement may further improve the stability of the snap-fit connection between the bracket 20 and the elongate carrier 12.

Although in the arrangement depicted in FIGS. 1 to 3, the elongate carrier 12 has a plurality of apertures 21 and the bracket 20 has a plurality of protrusions 22 configured to engage with the recesses 21 on the elongate carrier 12, this arrangement may be reversed. In particular, in an arrangement, the elongate carrier 12 may have a plurality of protrusions configured to engage with suitably arranged recesses provided on the bracket 20.

The overall arrangement of the ceiling system as depicted in FIG. 1 includes at least two elongate carriers 12, configured to support at least one ceiling panel 11, at least one elongate beam 15; and at least two connecting brackets 20; and each elongate carrier 12 is supported at one or more suspension locations 14, and each elongate beam 15 is coupled to at least two elongate carriers 12 by a respective connecting bracket 20 and the connecting brackets 20 are coupled to the elongate carriers 12 by a push-fit connection. Such an arrangement may improve the stability of the ceiling system and may further facilitate installation of the connecting brackets to the carriers and thus the overall installation of the ceiling system.

In an arrangement, the connecting brackets may be coupled to the elongate beam by a push-fit connection. FIGS. 1-3 illustrate this arrangement and show the elongate beam coupled to the bracket 20 by a push-fit connection, such as by a snap-fit connection.

As shown in the arrangement depicted in FIGS. 1 and 2, the elongate beam comprises a profile having a base with first and second edges, and at least one of first and second side faces extending from the first and second edges of the base, respectively. Thus, the elongate beam 15 may include or may be formed from a generally U-shaped profile. In such an arrangement, the elongate beam may have a base 30 and first and second side faces 31, 32 extending, respectively, from first and second edges 33, 34 of the base 30. The first and second side faces 31, 32 may be configured to engage with the bracket 20 in order to connect the elongate beam 15 to the bracket 20.

In the arrangement depicted in FIGS. 1 to 3, the first and second side faces 31, 32 of the elongate beam 15 have respective protrusions 35, 36 that are configured to engage with respective recesses 37, 38 provided on engagement sections 39 provided on the bracket 20. Thus, in this arrangement, at least one of the side faces of the elongate beam may have an elongate protrusion and the connecting brackets may have at least one recess to receive a part of the elongate protrusion.

As shown in in the arrangement of FIG. 3, in an arrangement the bracket 20 may have engagement sections 39 with associated recesses 37, 38 provided on both sides 25, 26 of the bracket 20. Such an arrangement may improve the stability of the snap-fit connection between the bracket 20 and the elongate beam 15.

It should be appreciated that variations of the bracket 20 depicted in FIG. 3 may be utilised and at least one of the side faces of the elongate beam may have an elongate recess and that the connecting brackets may have at least one protrusion, to engage with a part of the elongate recess. For example, in an arrangement, a snap-fit connection between the bracket 20 and the elongate beam 15 may be provided in which protrusions on the bracket 20 engage with recesses or apertures provided on the elongate beam 15. Such recesses or apertures may be provided, for example, on the first and second side faces 31, 32 of the elongate beam 15 in arrangement in which a U-shaped profile is used for the beam 15. Recesses or protrusions 35, 36 provided on the elongate beam 15 to engage with engagement sections 39 provided on the bracket 20 may be elongate. Such an arrangement is depicted in FIG. 2, in which the protrusions 35, 36 are inwardly-turned edges of the first and second side faces 31, 32, respectively, of the elongate beam 15. Alternatively, the elongate beam 15 may be provided with a plurality of separate protrusions or recesses configured to engage with engagement sections 39 provided on the bracket 20.

It should also be appreciated that the elongate beam 15 need not be formed from or have U-shaped profile. Other arrangements, including L-shaped profiles and V-shaped profiles may be used with a suitable arrangement to provide a push-fit connection between the elongate beam 15 and the bracket 20. Even beam shapes with a closed profile are possible, for example a closed profile having a rectangular cross-section could be used.

In some arrangements, such as those depicted in FIGS. 1 to 3, the nature of the push-fit connection between the elongate beam 15 and the bracket 20 may be such that, even once the elongate beam 15 has been connected to the bracket 20, the position of the elongate beam 15 relative to the bracket 20 may be adjusted in the direction parallel to the elongate length of the elongate beam 15 if a user exerts sufficient force. This may facilitate correct positioning of the bracket 20, and therefore the elongate carrier 12, relative to the elongate beam 15. In an arrangement, the push-fit connection between the elongate beam 15 and the bracket 20 may be such that the elongate beam 15 is connected to the bracket 20 by inserting a first end of the elongate beam 15 into the bracket 20 and then moving the elongate beam 15 in a direction parallel to the elongate length of the elongate beam 15 until the desired relative position is attained.

Figure 4:
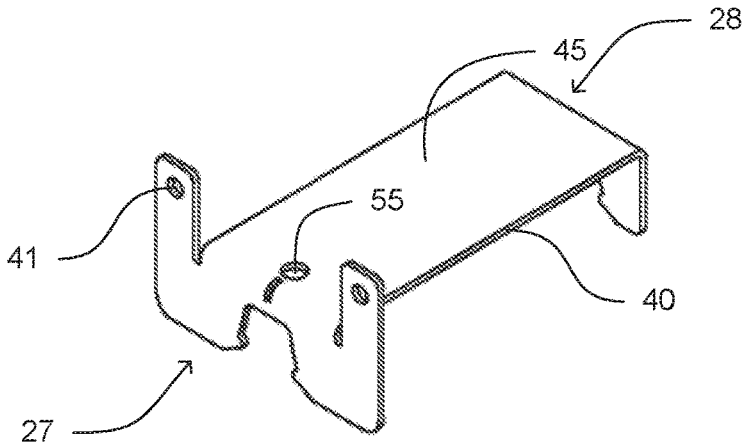
FIG. 4 illustrates an alternative bracket for use in a ceiling system.

In an arrangement, the ceiling system 10 may use a bracket 40, such as that depicted in FIG. 4, which does not connect to the elongate beam 15 using a push-fit connection. In such an arrangement, the bracket 40 includes one or more apertures 41 that are used to connect an elongate beam 15 to the bracket 40 using a standard fixing, such as a bolt. In such an arrangement, the elongate beam 15 may be provided with a plurality of apertures to receive the fixing at any of multiple locations for connection of the elongate beam 15 at a desired location relative to the bracket 40. One or both of the apertures provided in the elongate beam 15 and the bracket 40 may be elongate in order to enable fine adjustment of the position of the elongate beam 15 relative to the bracket 40 in a direction parallel to the elongate length of the beam 15 before a fixing is secured to fix the position of the bracket 40 relative to the elongate beam 15.

As discussed above, in arrangements a bracket 20, 40 connecting an elongate beam 15 and an elongate carrier 12 may engage with the elongate carrier 12 at first and second ends 27, 28 of the bracket, which may assist in providing a stable connection between the bracket and the elongate carrier. In some arrangements, such as those depicted in FIGS. 3 and 4, the bracket 20, 40 may include a section 45 that extends between the first and second ends 27, 28 of the bracket 20, 40. The bracket 20, 40 may be configured such that, when the bracket 20, 40 is connected to the elongate carrier 12, the section 45 of the bracket 20, 40 connecting the first and second ends 27, 28 is arranged above the elongate carrier 12, namely on the side of the carrier 12 that is opposite the side to which the ceiling panels 11 are connected. Such an arrangement may ensure that the presence of the bracket 20, 40 does not interfere with the connection of the ceiling panels 11 to the elongate carrier 12.

Figure 5:
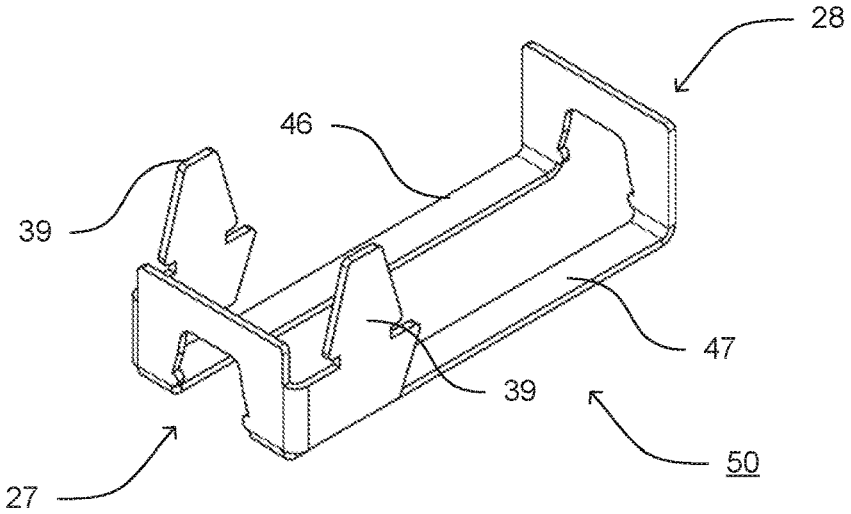
FIG. 5 illustrates an alternative bracket for use in a ceiling system.

In an alternative arrangement, depicted in FIG. 5, the first and second ends 27, 28 of the bracket 50 are connected by sections 46, 47 of the bracket 50 that, when the bracket 50 is connected to the elongate carrier 12, are located adjacent to the first and second sides 23, 24 of the elongate carrier 12.

In an arrangement of the ceiling system 10, the elongate beam 15 may be arranged to be provided directly above one of the ceiling panels 11. Such an arrangement may reduce the likelihood of the elongate beam 15 being visible from below the ceiling system 10, namely by occupants of the space below the ceiling system 10. This may be particularly beneficial if there are gaps provided between adjacent ceiling panels 11, such as in an arrangement as depicted in FIG. 1.

Use of a bracket 50 such that depicted in FIG. 5 may facilitate the correct positioning of a bracket 50 when connecting it to an elongate carrier 12 such that, when an elongate beam 15 is connected to the bracket 50, the elongate beam 15 is positioned above one of the ceiling panels 11. For example, the shape of the bracket 50 may enable a user to see the elongate carrier 12 when connecting the bracket 50 to the elongate carrier. The user may therefore be able to identify visually that the one or more engagement sections 39 of the bracket 50, provided to engage with the elongate beam 15, are directly above engagement sections provided on the elongate carrier 12 for connection to a ceiling panel 11.

In the case of a bracket 20, 40 such as that depicted in FIGS. 3 and 4, an aperture 55 may be provided to facilitate correct positioning of the bracket 20, 40 relative to the elongate carrier 12 for aligning the elongate beam 15 with a ceiling panel 11. The aperture 55 in the bracket 20, 40 may facilitate a user visually to align the bracket 20, 40 with a feature provided on the elongate carrier 12, such as a corresponding aperture in the elongate carrier 12 and/or a marker provided on the surface of the elongate carrier 12 that is visible when the aperture 55 in the bracket 20, 40 is aligned with the marker.

As will be apparent from the arrangement discussed above, the ceiling system 10 may be configured such that the elongate direction of the elongate beam 15 is parallel to an elongate direction of the ceiling panels 11. For example, the ceiling panels 11 may be elongate and oriented such that their elongate direction is perpendicular to the elongate direction of the elongate carriers 12, and the elongate beam 15 may be connected to the elongate carriers 12 by the brackets 20, 40, 50 in such a manner that the elongate beams 15 are perpendicular to the elongate carriers 12. Thus in at least one configuration of the ceiling system, at least one connecting bracket is configured to fix the orientation of an elongate beam relative to the orientation of an elongate carrier coupled to it by the connecting bracket.

However, in other arrangements, the elongate beam 15 may be connected to the elongate carrier 12 such that the angle between their respective orientations is not perpendicular. In an arrangement, not shown in the Figures, a bracket for connecting the elongate beam 15 to the elongate carrier 12 may be configured to connect the elongate beam 15 to the elongate carrier 12 at a fixed angle or orientation other than perpendicular.

Figure 6:
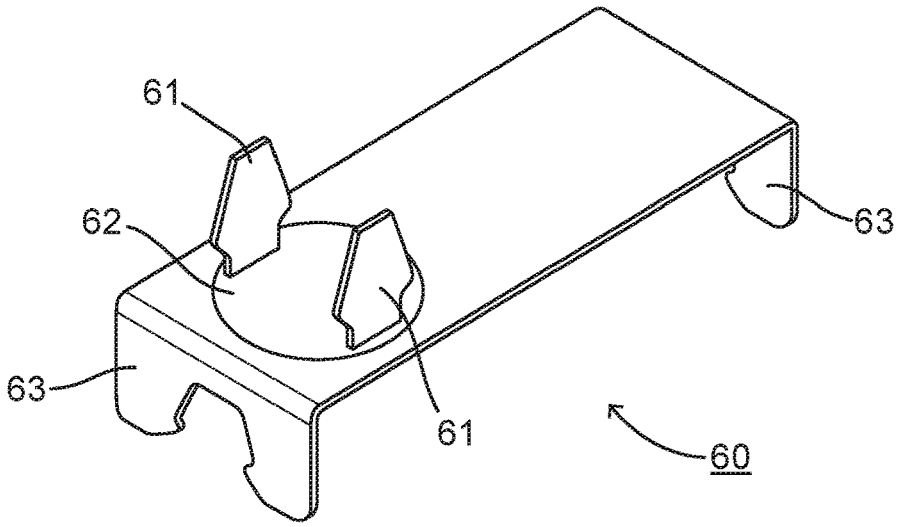
FIG. 6 illustrates an alternative bracket for use in a ceiling system.

In an arrangement, the bracket may be configured such that initially the angle between the orientation of the beam 15 and the orientation of the elongate carrier 12 can be adjusted but, subsequently, the relative orientation may be fixed. For example, as illustrated in FIG. 6, the sections 61 of a bracket 60 that engage the elongate beam may be mounted on a ratchet disk 62 or similar element/structure/member that is mounted on a part of the bracket 60 that includes the sections 63 of the bracket 60 that connect to the elongate carrier 12. Until the ratchet disk 62 is secured relative to the sections 63 of the bracket 60 that connect to the elongate carrier 12, it may rotate relative to the sections 63 of the bracket 60 that connect to the elongate carrier 12. With such an arrangement, the relative orientation of the elongate beam 15 to the elongate carrier 12, namely the angle of the elongate direction of the elongate beam 15 relative to the elongate direction of the elongate carrier 12, can be selected during the process of connecting them together.

In an arrangement of the ceiling system, the connecting bracket is configured such that the orientation of the elongate beam relative to the orientation of the elongate carrier coupled by the connecting bracket can be selected.

In an arrangement, an elongate carrier 12 may be formed from two or more sections of elongate carrier that are joined end-to-end in a direction parallel to the length of the elongate carrier 12. Such an arrangement may be beneficial for a ceiling system 10 to cover a large area.

In an arrangement, sections of an elongate carrier 12 may be connected by a carrier splice. For an arrangement using an elongate carrier 12 such as that depicted in FIGS. 1 and 2, the carrier splice may have protrusions that correspond to those of the bracket 20 that are configured to engage with the recesses or apertures 21 on the elongate carrier 12. The elongate carrier 12 may have a plurality of such recesses or apertures 21 to enable connection of the brackets 20 at any of a plurality of locations. Accordingly, some of the recesses or apertures 21 on the elongate carrier 12 may be utilised to engage with the bracket 20 and others may be utilised to engage with the carrier splice used to connect together two sections of the elongate carrier 12. Such an arrangement may simplify the manufacture of the elongate carriers 12 because separate elements are not required for provision of a snap-fit connection to the bracket 20 and for provision of a snap-fit connection to a carrier splice.

It should be appreciated that if, as discussed above, an arrangement is provided in which the elongate carrier 12 has protrusions that interact with recesses in the bracket 20, a carrier splice may similarly be provided with appropriate recesses to engage with the protrusions of the elongate carrier 12 in order to provide a snap-fit connection between the carrier splice and the sections of the elongate carrier 12.

In an arrangement, the bracket provided to connect the elongate beam 15 to the elongate carrier 12 may be configured such that it can additionally connect two sections of elongate carrier 12, in other words such that it can additionally function as a carrier splice.

As shown in FIG. 1, the ceiling panels 11 may be coupled to the elongate carriers 12 by a push-fit connection in which the ceiling panels 11 directly engage with the elongate carriers 12.

Figure 7:
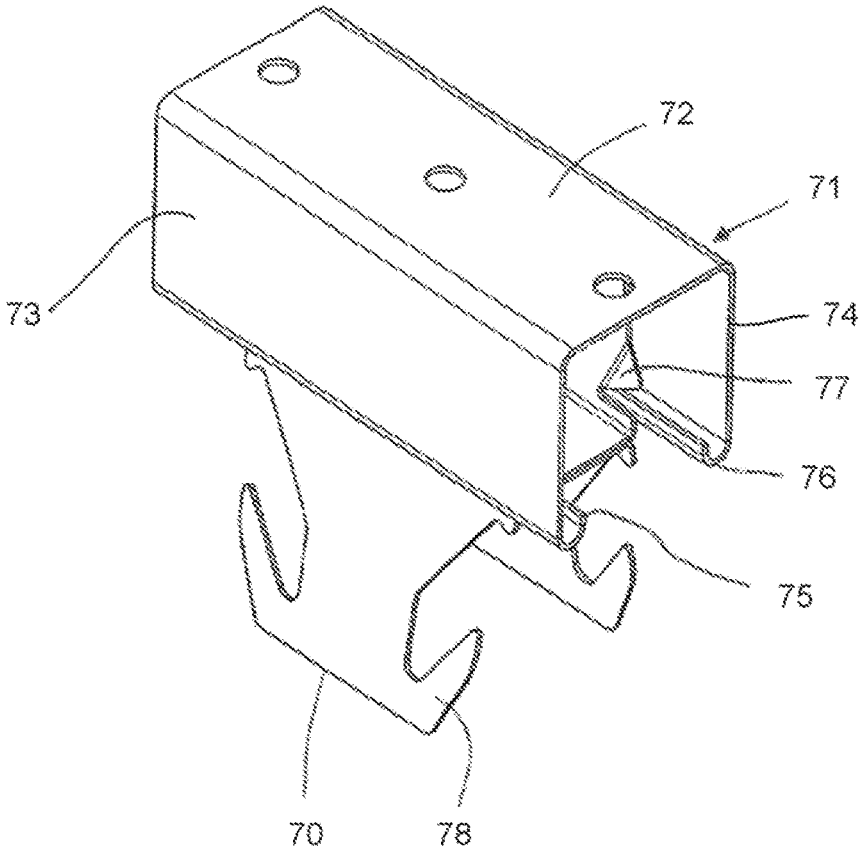
FIG. 7 illustrates an alternative arrangement for an elongate carrier for use in a ceiling system.

In an alternative arrangement, as depicted in FIG. 7, the ceiling panels 11 may be supported by clip 70, arranged between an elongate carrier 71 and the ceiling panel 11. The clip 70 may be configured to be connected to the elongate carrier 71 by a push-fit connection and to the ceiling panel 11 by a push-fit connection. Use of such a clip 70 may enable the use of a simpler design of elongate carrier 71.

In the arrangement shown in FIG. 7, the elongate carrier 71 is formed from a generally U shaped profile. In such an arrangement, the elongate carrier 71 may have a base 72 and first and second side faces 73, 74 extending, respectively, from first and second edges of the base 72. The first and second side faces 73, 74 may be configured to engage with the clip 70 in order to couple the clip 70 to the elongate carrier 71.

In the arrangement depicted in FIG. 7, the first and second side faces 73, 74 of the elongate carrier 71 have respective protrusions 75, 76 that are configured to engage with respective recesses 77 provided on the clip 70 to form a push-fit connection. As shown in FIG. 7, the clip 70 also includes push-fit connectors 78 provided to engage with a ceiling panel 11 to provide a push-fit connection. Other arrangements of push-fit connection may be used for coupling the clip 70 to the elongate carrier 71 and/or the ceiling panels 11.

FIGS. 8 to 11 depict further variations of brackets 80, 90, 100, 110 that are examples of brackets that may be used to couple an elongate carrier 71 such as that depicted in FIG. 7 to an elongate beam 15 in accordance with the present disclosure. FIG. 12 depicts each of the brackets 80, 90, 100, 110 depicted in FIGS. 8 to 10, respectively, each connecting an elongate beam 15 to an elongate carrier 12. The arrangement shown in FIG. 12 is for convenience of depicting each of the brackets 80, 90, 100, 110 depicted in FIGS. 8 to 10 in use and is not intended to depict a ceiling system in use. It will be appreciated that in use, a ceiling system may include only a single type of bracket 20, 40, 50, 60, 80, 90, 100, 110 or may include more than one type of bracket.

Figure 8:
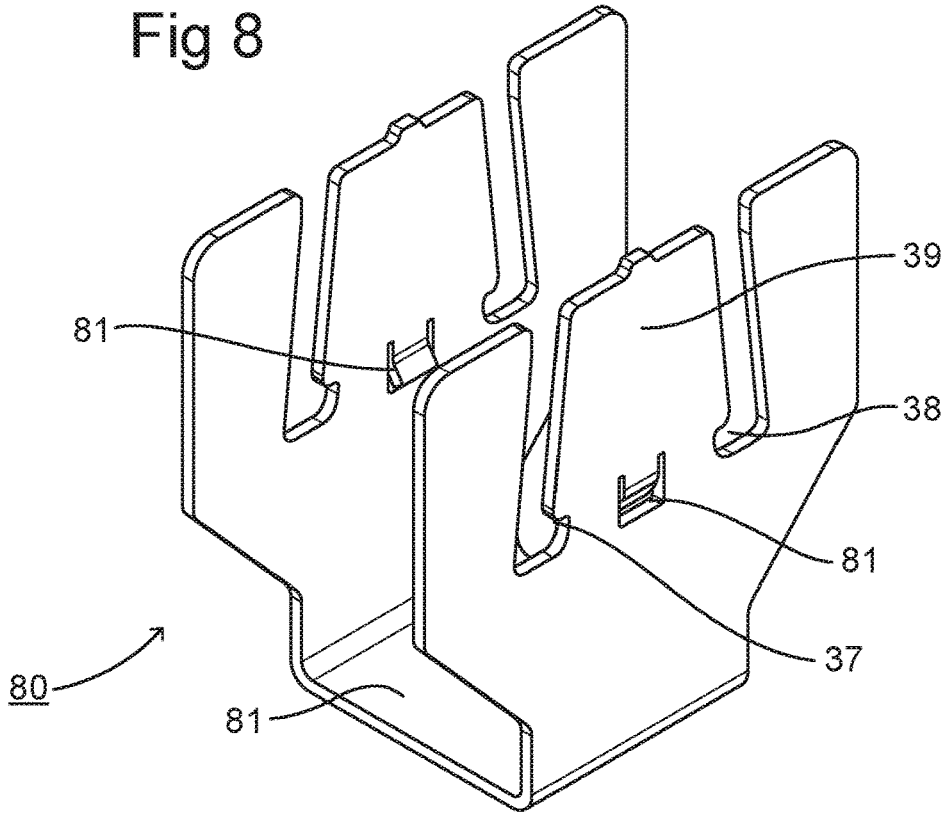
FIG. 8 illustrates an alternative bracket for use in a ceiling system.

The bracket 80 depicted in FIG. 8 forms a push-fit connection to an elongate beam 15 in a corresponding manner to the bracket 20 shown in FIG. 3. In particular, the bracket 80 may have recesses 37, 38 provided on engagement sections 39 that are configured to engage with protrusions 35, 36 on the elongate beam 15. In order to form the push-fit connection to the elongate carrier 71, the bracket 80 has deformable protrusions 81 that, in conjunction with the base 82 of the bracket 80, couple the bracket 80 to the elongate carrier 71. The deformable protrusions 81 may deform to permit the elongate carrier 71 to be inserted into the bracket 80 and then engage with the base 72 of the elongate carrier 71 to hold the elongate carrier 71 against the base 81 of the bracket 80.

Figure 9:
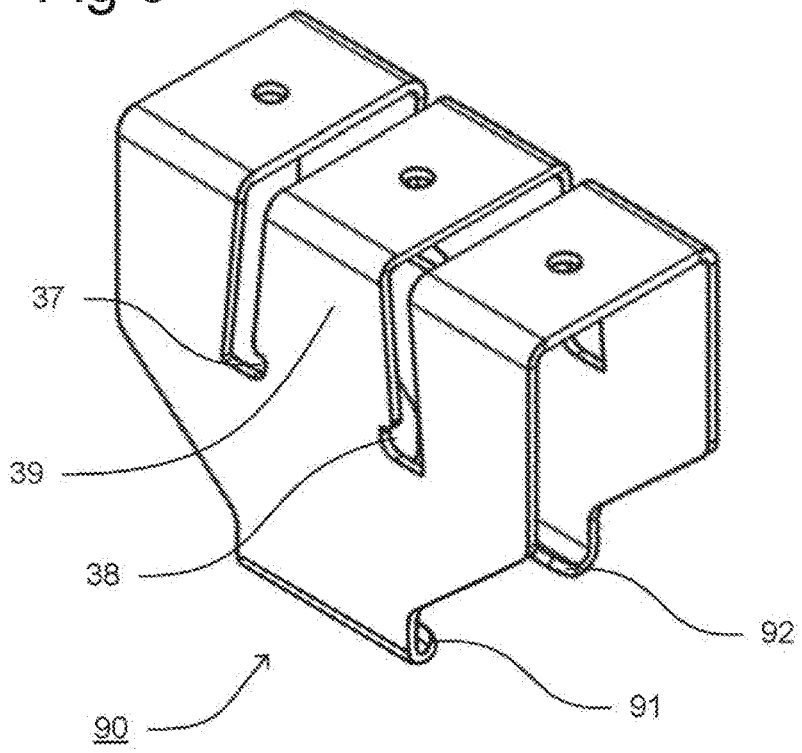
FIG. 9 illustrates an alternative bracket for use in a ceiling system.

The bracket 90 depicted in FIG. 9 also forms a push-fit connection to an elongate beam 15 in a corresponding manner to the bracket 20 shown in FIG. 3. In particular, the bracket 90 has recesses 37, 38 provided on engagement sections 39 that are configured to engage with protrusions 35, 36 on the elongate beam 15. In order to form the push-fit connection to the elongate carrier 71, the bracket 90 has protrusions 91, 92 formed on respective side sections 93, 94. When the elongate carrier 71 is coupled to the bracket 90, the protrusions 91, 92 of the bracket 90 engage with respective protrusions 75, 76 on the first and second side faces 73, 74 of the elongate carrier 71, preventing movement of the elongate carrier 71 away from the bracket 90. When assembling a ceiling system, the bracket 90 may first be coupled to the elongate beam 15 and then the elongate carrier 71 may be coupled to the combination of the elongate beam 15 and bracket 90. This may reduce the likelihood of the bracket 90 detaching from the elongate carrier 71.

Figure 10:
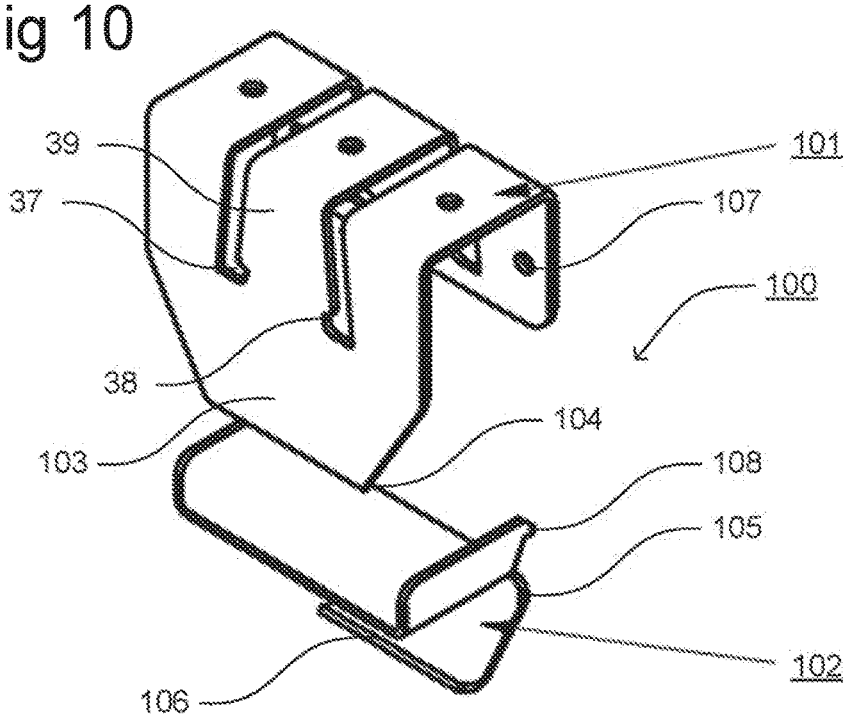
FIG. 10 illustrates an alternative bracket for use in a ceiling system

The bracket 100 depicted in FIG. 10 is similar to that depicted in FIG. 9 but is formed in two parts 101, 102. The first part 101 includes recesses 37, 38 provided on engagement sections 39 that are configured to engage with protrusions 35, 36 on the elongate beam 15 and a first side section 103 with a protrusion 104. The second part 102 includes a second side section 105 with a protrusion 106. The first and second parts 101, 102 of the bracket 100 may be coupled together by engagement of one or more protrusions on one part with corresponding recesses on the other part. For example, as shown in FIG. 10, a protrusion 108 formed on the second part 102 may engage with a recess 107 formed on the first part 101.

In order to couple the elongate carrier 71 to the bracket 100 the first and second parts 101, 102 of the bracket 100 are coupled to one another and the protrusions 104, 106 of the bracket 100 engage with respective protrusions 75, 76 on the first and second side faces 73, 74 of the elongate carrier 71, preventing movement of the elongate carrier 71 away from the bracket 100. Such an arrangement may facilitate the process of assembling the ceiling system.

Figure 11:
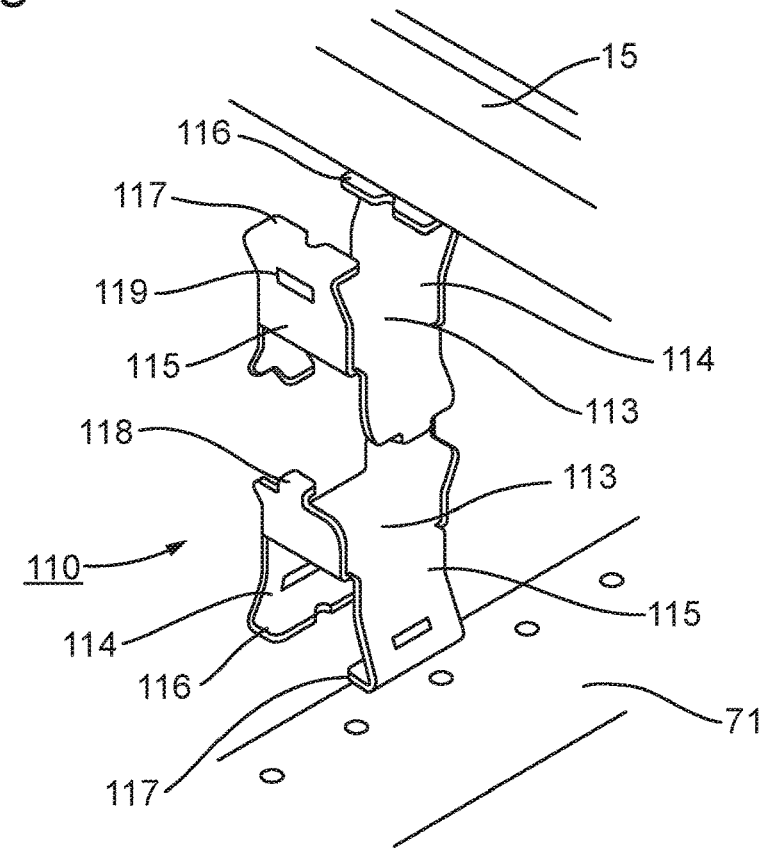
FIG. 11 illustrates an alternative bracket for use in a ceiling system.
Figure 12:
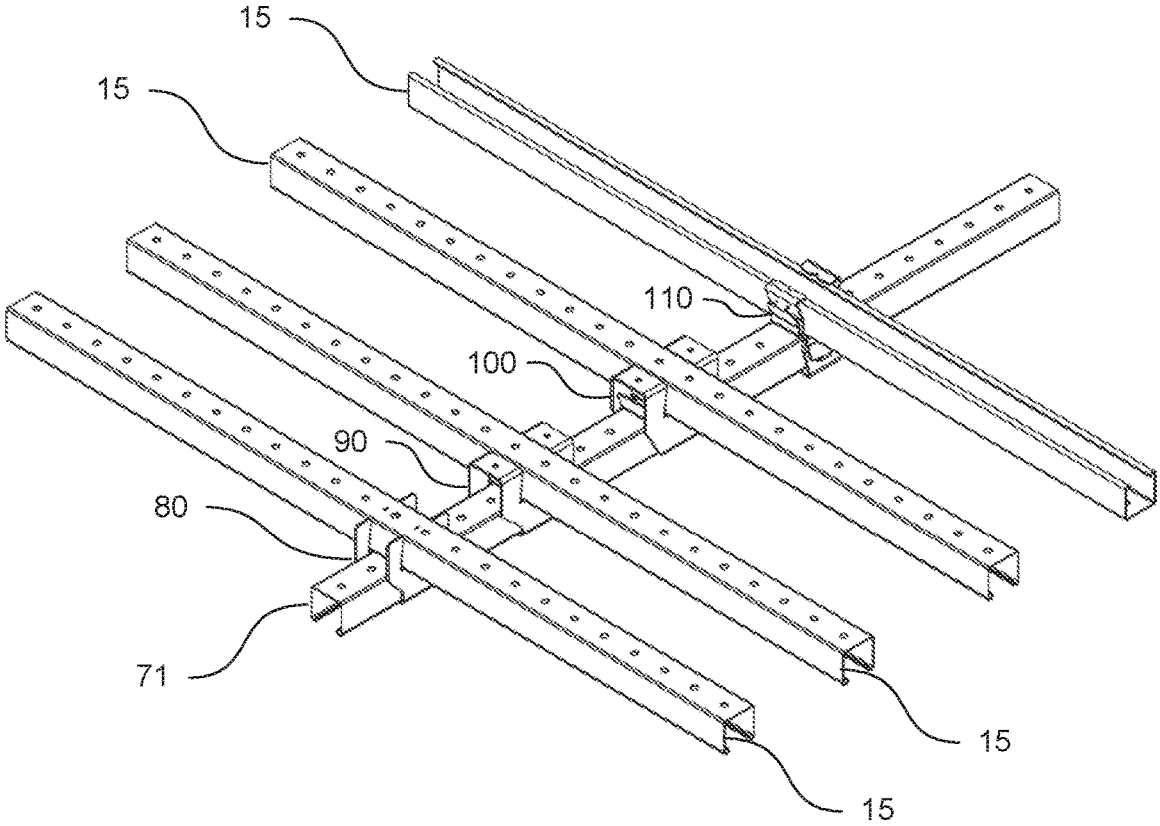
FIG. 12 illustrates the brackets of FIGS. 8 to 11 when used to couple an elongate beam to an elongate carrier.

The bracket 110 depicted in FIG. 11 is also formed in first and second parts 111, 112. Each of the two parts 111, 112 has a base 113 and first and second side surfaces 114, 115 with respective protrusions 116, 117. The first and second parts 111, 112 of the bracket 110 are configured such that they can respectively be coupled to the elongate carrier 71 and the elongate beam 15 such that the elongate carrier 71 or elongate beam 15 is held between the base 113 and the protrusions 116, 117 of the respective part 111, 112 of the bracket 110.

The first and second parts 111, 112 of the bracket 110 may be coupled by engagement of a push-fit connection, for example by engagement of protrusions 118 on one of the first and second parts 111, 112 of the bracket 110 with recesses or apertures 119 on the other of the first and second parts 111, 112 of the bracket 110. As shown in FIG. 11, in an arrangement the first and second parts 111, 112 of the bracket 110 may have the same shape. This may simplify manufacture because it only requires the forming of two copies of the same part.

These and other features and advantages of the present disclosure will be readily apparent from the detailed description, the scope of the invention being set out in the appended claims.

The present disclosure is set forth in various levels of detail in this application and no limitation as to the scope of the claimed subject matter is intended by either the inclusion or non-inclusion of elements, components, or the like in the summary. In certain instances, details that are not necessary for an understanding of the disclosure or that render other details difficult to perceive may have been omitted. It should be understood that the claimed subject matter is not necessarily limited to the particular embodiments or arrangements illustrated herein.

The accompanying drawings are provided for purposes of illustration only, and the dimensions, positions, order, and relative sizes reflected in the drawings attached hereto may vary. The detailed description will be better understood in conjunction with the accompanying drawings, with reference made in detail to embodiments of the present subject matter, one or more examples of which are illustrated in the drawings. Each example is provided by way of explanation of the present subject matter, not limitation of the present subject matter. In fact, it will be apparent to those skilled in the art that various modifications and variations can be made in the present disclosure without departing from the scope or spirit of the present subject matter. Thus, it is intended that the present subject matter covers such modifications and variations as come within the scope of the appended claims and their equivalents.

In the foregoing description, it will be appreciated that the phrases "at least one", "one or more", and "and/or", as used herein, are open-ended expressions that are both conjunctive and disjunctive in operation. The term "a" or "an" entity, as used herein, refers to one or more of that entity. As such, the terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, counterclockwise, and/or the like) are only used for identification purposes to aid the reader's understanding of the present disclosure, and/or serve to distinguish regions of the associated elements from one another, and do not limit the associated element, particularly as to the position, orientation, or use of this disclosure.

The invention claimed is:

1. A ceiling system, comprising:

at least two elongate carriers, configured to support at least one ceiling panel;

at least one elongate beam; and at least two connecting brackets;

wherein:

each elongate carrier is supported at one or more suspension locations;

each elongate beam is coupled to at least two elongate carriers by a respective connecting bracket;

the connecting brackets are coupled to the elongate carriers by a push-fit connection:

at least one connecting bracket has a first end and a second end, each configured to engage with a respective location on an elongate carrier, said locations separated in the elongate direction of the elongate carrier; and said first and second ends of the connecting bracket are connected by a section of the connecting bracket that, when the connecting bracket is coupled to an elongate carrier, is located on an opposite side of the elongate carrier to the position of the ceiling panels when they are coupled to the elongate carrier.

2. A ceiling system according to claim 1, wherein the connecting brackets are coupled to the elongate beam by a push-fit connection.

3. A ceiling system according to claim 2, wherein the elongate beam comprises a profile having a base with first and second edges, and at least one of first and second side faces extending from the first and second edges of the base, respectively.

4. A ceiling system according to claim 3, wherein either:

at least one of the side faces of the elongate beam comprises an elongate protrusion and the connecting brackets comprise at least one recess, configured to receive a part of the elongate protrusion; or at least one of the side faces of the elongate beam comprises an elongate recess and the connecting brackets comprise at least one protrusion, configured to engage with a part of the elongate recess.

5. A ceiling system according to claim 1, wherein one of the connecting brackets and the elongate carrier comprises at least two recesses and the other of the connecting brackets and the elongate carriers comprises at least two corresponding protrusions; and the connecting brackets are configured to couple to the elongate carriers by engagement of the protrusions within the recesses.

6. A ceiling system according to claim 1, wherein at least one connecting bracket is configured to fix the orientation of an elongate beam relative to the orientation of an elongate carrier coupled to it by the connecting bracket.

7. A ceiling system according to claim 6, wherein at least one connecting bracket is configured such that the elongate direction of an elongate beam is perpendicular to the elongate direction of an elongate carrier coupled to it by the connecting bracket.

8. A ceiling system according to claim 6, wherein the at least one connecting bracket is configured such that the orientation of the elongate beam relative to the orientation of the elongate carrier coupled by the connecting bracket can be selected.

9. A ceiling system according to claim 1, further comprising at least two suspension hangers, configured to support the ceiling system from a structure;

wherein the suspension hangers are directly coupled to the elongate carriers at the suspension locations.

10. A ceiling system according to claim 1, wherein the elongate carriers are configured such that the at least one ceiling panel can be coupled to the elongate carriers by a push-fit connection.

11. A ceiling system according to claim 1, further comprising at least one ceiling panel supported by the elongate carriers.

12. A ceiling system according to claim 11, wherein the parts of at least one connecting bracket used to couple the connecting bracket to an elongate beam and an elongate carrier are located relative to each other such that, when the elongate beam and ceiling panel are coupled to the elongate carrier, the elongate beam is directly above the ceiling panel.

13. A ceiling system according to claim 11, wherein the at least one ceiling panel is more flexible than at least one of the elongate carriers and the at least one elongate beam.

14. A ceiling system, comprising:

at least two elongate carriers, configured to support at least one ceiling panel;

at least one elongate beam; and at least two connecting brackets;

wherein each elongate carrier is supported at one or more suspension locations;

each elongate beam is coupled to at least two elongate carriers by a respective connecting bracket;

the connecting brackets are coupled to the elongate carriers by a push-fit connection;

at least one connecting bracket has a first end and a second end, each configured to engage with a respective location on an elongate carrier, said locations separated in the elongate direction of the elongate carrier; and said first and second ends of the connecting bracket are connected by first and second sections of the connecting bracket that, when the connecting bracket is coupled to an elongate carrier, are located on either side of the elongate carrier.

15. A ceiling system according to claim 14, wherein the connecting brackets are coupled to the elongate beam by a push-fit connection.

16. A ceiling system according to claim 15, wherein the elongate beam comprises a profile having a base with first and second edges, and at least one of first and second side faces extending from the first and second edges of the base, respectively.

17. A ceiling system according to claim 16, wherein either:

at least one of the side faces of the elongate beam comprises an elongate protrusion and the connecting brackets comprise at least one recess, configured to receive a part of the elongate protrusion; or at least one of the side faces of the elongate beam comprises an elongate recess and the connecting brackets comprise at least one protrusion, configured to engage with a part of the elongate recess.

18. A ceiling system according to claim 14, wherein at least one connecting bracket is configured to fix the orientation of an elongate beam relative to the orientation of an elongate carrier coupled to it by the connecting bracket.

19. A ceiling system, comprising:

at least two elongate carriers, configured to support at least one ceiling panel;

at least one elongate beam, the elongate beam comprising a profile having a base with first and second edges, and at least one of first and second side faces extending from the first and second edges of the base, respectively; and at least two connecting brackets;

wherein each elongate carrier is supported at one or more suspension locations;

each elongate beam is coupled to at least two elongate carriers by a respective connecting bracket;

the connecting brackets are coupled to the elongate carriers by a push-fit connection; and the connecting brackets are coupled to the elongate beam by a push-fit connection;

wherein either:

at least one of the side faces of the elongate beam comprises an elongate protrusion and the connecting brackets comprise at least one recess, configured to receive a part of the elongate protrusion; or at least one of the side faces of the elongate beam comprises an elongate recess and the connecting brackets comprise at least one protrusion, configured to engage with a part of the elongate recess.

20. A ceiling system according to claim 19, wherein at least one connecting bracket is configured to fix the orientation of an elongate beam relative to the orientation of an elongate carrier coupled to it by the connecting bracket.

21. A ceiling system according to claim 19, wherein at least one connecting bracket has a first end and a second end, each configured to engage with a respective location on an elongate carrier, said locations separated in the elongate direction of the elongate carrier.

22. A ceiling system according to claim 21, wherein said first and second ends of the connecting bracket are connected by a section of the connecting bracket that, when the connecting bracket is coupled to an elongate carrier, is located on an opposite side of the elongate carrier to the position of the ceiling panels when they are coupled to the elongate carrier.

23. A ceiling system according to claim 21, wherein said first and second ends of the connecting bracket are connected by first and second sections of the connecting bracket that, when the connecting bracket is coupled to an elongate carrier, are located on either side of the elongate carrier.

* * * * *